US010443480B2

(12) United States Patent
Takeuchi

(10) Patent No.: US 10,443,480 B2
(45) Date of Patent: Oct. 15, 2019

(54) EXHAUST DUCT

(71) Applicant: RINNAI CORPORATION, Aichi (JP)

(72) Inventor: Masaru Takeuchi, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 68 days.

(21) Appl. No.: 15/866,894

(22) Filed: Jan. 10, 2018

(65) Prior Publication Data

US 2018/0216515 A1 Aug. 2, 2018

(30) Foreign Application Priority Data

Jan. 30, 2017 (JP) ..... 2017-013823

(51) Int. Cl.

| | |
|---|---|
| ***F01N 13/10*** | (2010.01) |
| ***F23D 11/00*** | (2006.01) |
| ***F24H 9/00*** | (2006.01) |

(52) U.S. Cl.

CPC ..... *F01N 13/10* (2013.01); *F23D 11/00* (2013.01); *F24H 9/0026* (2013.01); *F01N 2340/00* (2013.01); *F01N 2340/04* (2013.01); *F01N 2470/10* (2013.01)

(58) Field of Classification Search

CPC .. F01N 13/10; F01N 2340/00; F01N 2340/04; F01N 2470/10; F23D 11/00; F24H 9/0026

See application file for complete search history.

(56) References Cited

U.S. PATENT DOCUMENTS 3,763,950 A * 10/1973 Rockwell ..... B60K 13/06 180/309

2007/0209606 A1* 9/2007 Hamada ..... F24H 1/43 122/18.1

FOREIGN PATENT DOCUMENTS

JP 2013-134010 A 7/2013

* cited by examiner

*Primary Examiner* — Brandon D Lee

(74) *Attorney, Agent, or Firm* — Cermak Nakajima & McGowan LLP; Tomoko Nakajima

(57) ABSTRACT

An exhaust duct has a riser duct section which is connected to an exhaust port having such an inlet port at a lower portion of the riser duct section as is connected to an exhaust port for the combustion gas. The riser duct section extends upward along an external surface of the combustion box. A horizontal direction perpendicular to the front-to-back direction is defined as a lateral direction, then the riser duct section is formed into a flat shape having a smaller dimension in the front-to-back direction than the dimension in the lateral direction. Fluctuations in width between front-side and back-side plate parts of the riser duct section are devised to be restrained, and increase in size can be avoided. The riser duct section has a rail inside the riser duct section, the rail being elongated in the vertical direction and connecting together the front-side and the back-side plate parts.

4 Claims, 7 Drawing Sheets

EXHAUST DUCT

BACKGROUND OF THE INVENTION

1. Technical Field

The present invention relates to an exhaust duct disposed on a combustion apparatus, the combustion apparatus comprising: a burner which ejects air-fuel mixture downward for combustion; and a combustion box which houses therein a heat exchanger heated by combustion gas and which is disposed under the burner.

2. Background Art

As this kind of exhaust duct, there is known one comprising: a riser duct section having such an inlet port at a lower-portion thereof as is connected to an exhaust port for combustion gas, the exhaust port being opened at a lower portion of the combustion box, the riser duct section extending upward along an external surface of the combustion box (see, e.g., JP-A-2013-134010). Suppose that a direction normal to the external surface of the combustion box is defined as a front-to-back direction, and that a horizontal direction perpendicular to the front-to-back direction is defined as a lateral direction. Then the riser duct section is formed into a flat shape having a smaller dimension in the front-to-back direction than the dimension in the lateral direction.

By forming the riser duct section into a flat shape as described above, the exhaust passage can be made narrower and the exhaust noises can be reduced. In the flat shape riser duct section, however, a front-side plate part and a back-side plate part become larger in area and, consequently, easily giving rise to deflections thereof. As a result, the width between the front-side and the back-side plate parts fluctuates, and the pressure loss becomes larger in the riser duct section of smaller width.

As a solution, in order to prevent the deflections of each of the front-side and the back-side plate parts from taking place by increasing the rigidity of each of the plate parts of the riser duct section, conventionally, there is also known one in which ribs are erected on the external surface of each of the plate parts. However, by disposing this kind of ribs, the dimensions in the front-to-back direction of the riser duct section increase, thereby resulting in the enlargement of the exhaust duct, and also in bigger size of the combustion apparatus.

SUMMARY

Problems that the Invention is to Solve

In view of the above points, this invention has a problem of providing an exhaust duct which is capable of restraining the fluctuations in width, between the front-side and the back-side plate parts of the riser duct section, and which is capable of avoiding an increase in size.

Means to Solve the Problems

In order to solve the above problem, this invention is an exhaust duct disposed on a combustion apparatus. The combustion apparatus comprises: a burner which ejects air-fuel mixture downward for combustion; and a combustion box which houses therein a heat exchanger heated by combustion gas and which is disposed under the burner. The exhaust duct comprises: a riser duct section having such an inlet port at a lower-portion thereof as is connected to an exhaust port for combustion gas. The exhaust port is opened at a lower portion of the combustion box and the riser duct section extends upward along an external surface of the combustion box. Suppose: that a direction normal to the external surface of the combustion box is defined as a front-to-back direction; that such a side of the riser duct section as is closer to the external surface of the combustion box is defined as a front side; that an opposite side thereof is defined as a back side; and that a horizontal direction perpendicular to the front-to-back direction is defined as a lateral direction, then the riser duct section is formed into a flat shape having a smaller dimension in the front-to-back direction than the dimension in the lateral direction. In the above arrangement, the riser duct section comprises a rail inside the riser duct section, the rail being elongated in the vertical direction and connecting together the front-side and the back-side plate parts.

According to this invention, since both the front-side and the back-side plate parts of the riser duct section are connected together by the rail, the fluctuations in width of the exhaust passage between both the plate parts can be restrained. Furthermore, since the rail is disposed on the inside of the riser duct section, the riser duct section will not increase in dimension in the front-to-back direction thereof. The exhaust duct can thus be prevented from getting large in size.

By the way, the exhaust duct further comprises a duct coupling part disposed in a lower portion of the riser duct section and at a position above the inlet port so as to couple the riser duct section from the back side thereof to the combustion box. In this case, the position of disposing the rail shall preferably be right above the duct coupling part. According to this arrangement, the combustion gas that comes in from the inlet port to flow upward by detouring around the duct coupling part will flow smoothly upward without striking the lower end of the rail. As a result, increase in the pressure loss and noises due to the occurrence of turbulent flows can be restrained.

Further, according to this invention, among: a distance between a side edge of laterally one side of the riser duct section and an adjoining rail; a distance between a side edge of laterally opposite side of the riser duct section and an adjoining rail; and, in case a plurality of rails are disposed, a distance between the respective rails; at least one of the above distances is varied from the remaining distances. In case a plurality of rails are disposed, lateral dimension or a vertical dimension of at least one of the rails shall be varied in the lateral dimension or vertical dimension of the remaining rails. According to this arrangement, the space partitioned by the rails comes to have natural frequencies that are respectively different from one another. As a result, the resonant vibrations of the exhaust duct due to flame vibrations and consequent resonance sound can be prevented.

PREFERRED EMBODIMENTS FOR CARRYING OUT THE INVENTION

Figure 1:
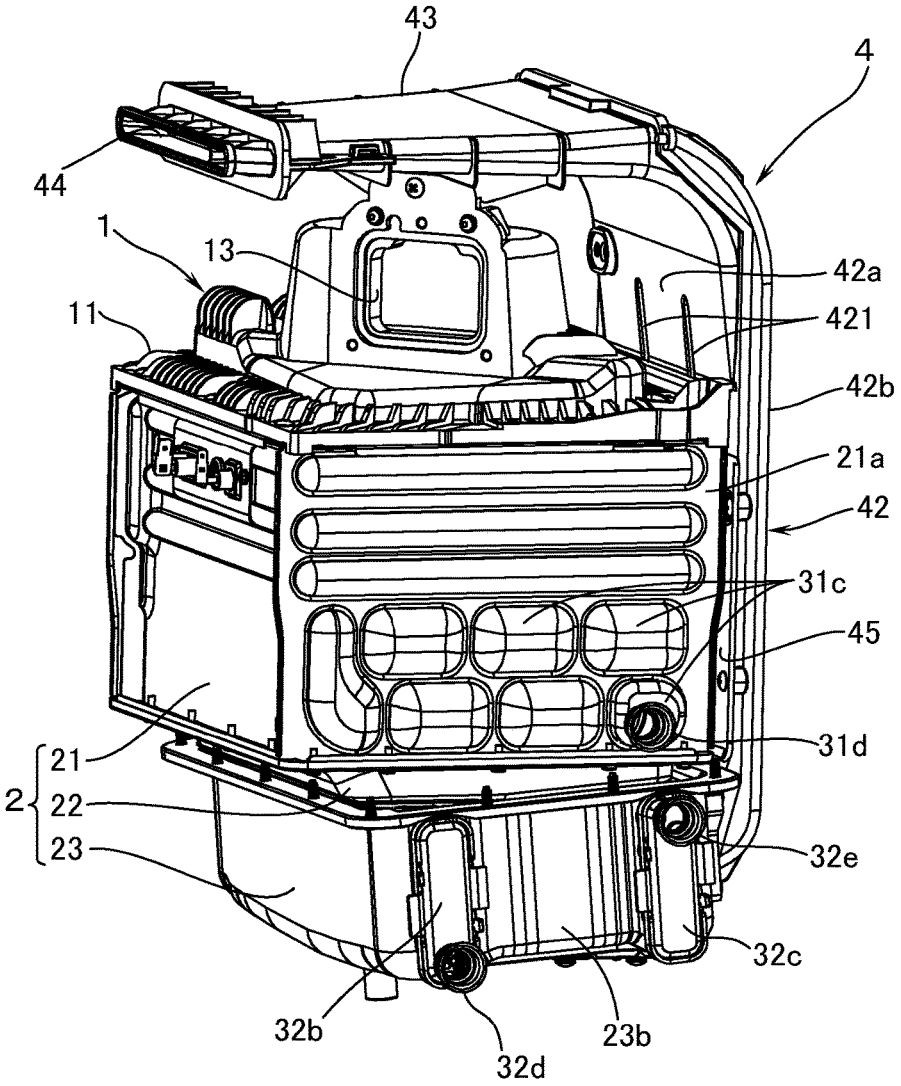
FIG. 1 is a perspective view of a combustion apparatus provided with the exhaust duct according to a first embodiment of this invention.
Figure 2:
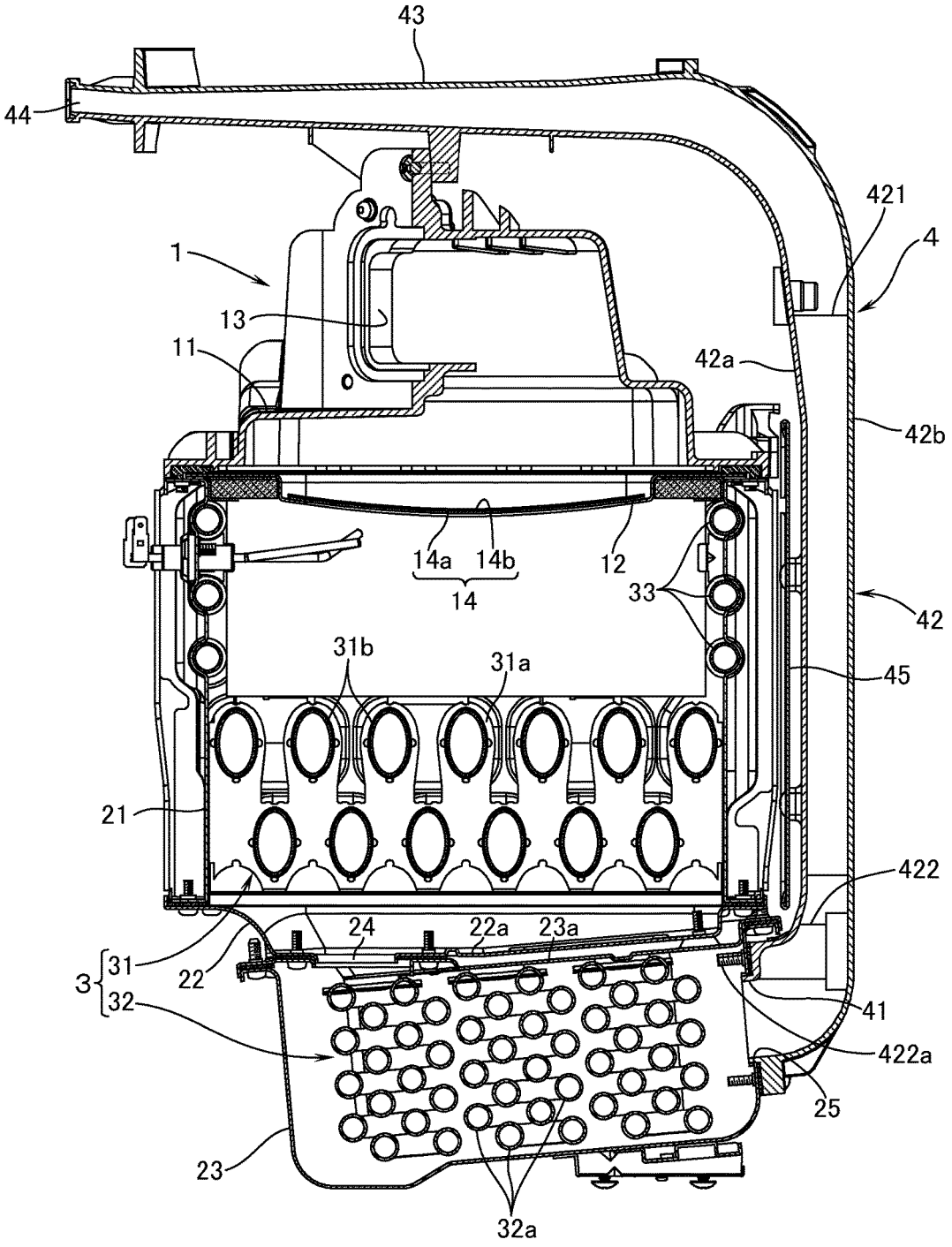
FIG. 2 is a side view, shown in section, of the combustion apparatus in FIG. 1.

FIGS. 1 and 2 show a combustion apparatus made up of a heat source appliance. This combustion apparatus comprises: a burner 1 which ejects air-fuel mixture downward for combustion; a combustion box 2 which is disposed on a lower side of the burner 1 and which houses therein a heat exchanger 3 for supplying hot water, the heat exchanger 3 being heated by the combustion gas that is generated by combustion of the air-fuel mixture; and an exhaust duct 4 for exhausting the combustion gas to the outside. By the way, the exhaust duct 4 has a riser duct section 42 which is elongated upward along an external surface of the combustion box 2. In the following description, a direction normal to that external surface of the combustion box 2 along which the riser duct section 42 is elongated is defined as a front-to-back direction, and a horizontal direction perpendicular to the front-to-back direction is defined as a lateral direction.

The burner 1 is provided with: a box-shaped burner body 11 which opens downward; and a combustion plate 12 which covers a downward opening surface of the burner body 11. The burner body 11 has, on an upper portion thereof, an inlet port 13 which opens sideways. In this arrangement, the air-fuel mixture is supplied from a fan (not illustrated) through the inlet port 13 into the burner body 11. This air-fuel mixture thus supplied is ejected downward from an air-fuel mixture ejection part 14 disposed in the combustion plate 12, thereby performing totally primary air combustion. The combustion plate 12 has a large opening in the central portion thereof. Textile fabric 14*a* made of heat-resistant fibers is mounted into this opening, and a distribution plate 14*b* having formed therein a multiplicity of distribution holes is overlapped on top of the textile fabric 14*a*. The textile fabric 14*a* and the distribution plate 14*b* thus constitute an air-fuel mixture ejection part 14.

The combustion box 2 is constituted by: an upper box 21 which is left open on both upper and lower surfaces and which is fastened, at an upper end portion thereof, to a periphery of the lower surface of the burner body 11; a flat and dish-like intermediate box 22 which is fastened to the lower end of the upper box 21; and a lower box 23 which is blocked at both the upper and lower surfaces and which has an upper plate part 23*a* to be fastened to a bottom plate part 22*a* of the intermediate box 22. A front portion of the bottom plate part 22*a* of the intermediate box 22 and the front portion of the upper plate part 23*a* of the lower box 23 are provided with a vent hole 24 in order to bring into communication with each other the internal space of the intermediate box 22 and the internal space of the lower box 23. Further, at a lower portion of the combustion box 2, i.e., in the lower box 23, the back surface thereof is provided with an exhaust port 25 for the combustion gas. It is thus so arranged that the combustion gas flows from inside the upper box 21 through the inside of the intermediate box 22, the vent hole 24, the inside of the lower box 23 and the exhaust port 25 into the exhaust duct 4.

The heat exchanger 3 is constituted by: a main heat exchanger 31 of fin-and-tube type which is disposed inside the upper box 21 and which is made up of a multiplicity of heat-absorbing fins 31*a*, and a plurality of heat-absorbing pipes 31*b* which penetrate through the heat-absorbing fins 31*a*; and a subsidiary heat exchanger 32 of latent-heat recovery type which is disposed inside the lower box 23 and which is made up of a plurality of upper and lower heat-absorbing pipes 32*a* elongated in the front-to-back direction in a snaking manner. On an external surface of the side plate portion 21*a* on laterally one side and on laterally the other side of the upper box 21, there are provided a plurality of connection lids 31*c* which define, between the respective side-plate 21*a*, connection passages of the adjoining two heat-absorbing pipes 31*b*, 31*b*. All the heat-absorbing pipes 31*b* are thus arranged to be connected in series. Further, a connection port 31*d* is provided in a connection lid 31*c* which defines, between the side plate 21*a* on laterally one side, a connection passage connected to the heat-absorbing pipes 31*b* on the upstream end.

Further, a side plate portion 23*b* on laterally one side of the lower box 23 is provided with: an inlet-side header lid 32*b* which defines, between the side plate portion 23*b*, a connection passage connecting together front end portions of a plurality of upper and lower heat-absorbing pipes 32*a* of the subsidiary heat exchanger 32; and an outlet-side header lid 32*c* which defines, between the side-plate portion 23*b*, a connection passage connecting together the back end portions of a plurality of upper and lower heat-absorbing pipes 32*a*. The inlet-side header lid 32*b* is provided with a water inlet port 32*d* for connecting thereto a water supply passage, and the outlet-side header lid 32*c* is provided with a connection port 32*e* to which is connected the above-mentioned connection port 31*d* through a piping (not illustrated). It is thus so arranged that the water from the water supply passage flows, via the subsidiary heat exchanger 32, to the main heat exchanger 31. Further, in that portion of the upper box 21 which is above the main heat exchanger 31, there is provided a water jacket 33 which is constituted by a plurality of upper and lower water pipes in which flows the water passing through the main heat exchanger 31, to prevent the said portion from being overheated. To a downstream end of the water jacket 33, there is connected the hot water supply passage.

Figure 3:
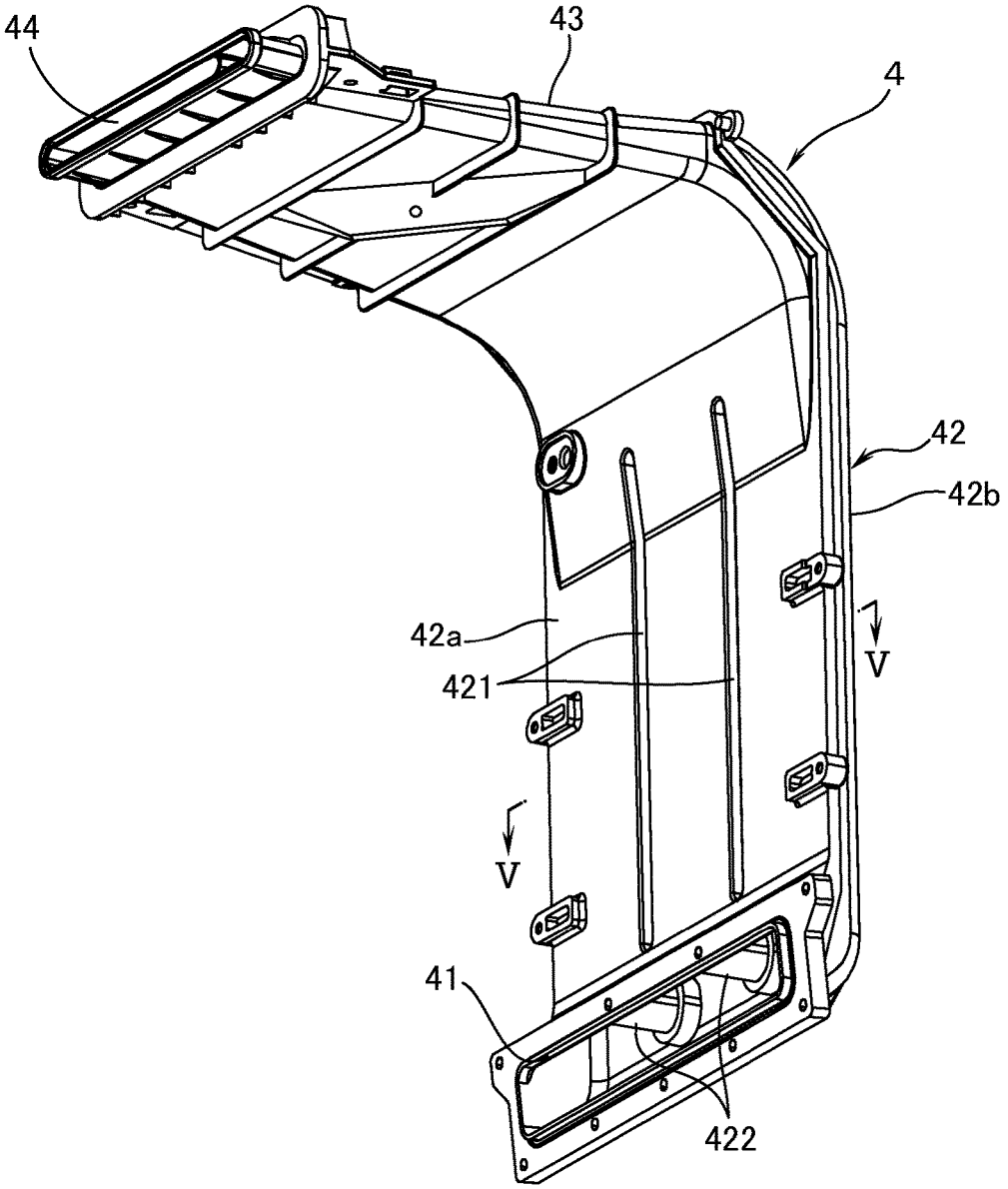
FIG. 3 is a perspective view, as seen from the front side, of the exhaust duct according to the first embodiment.
Figure 4:
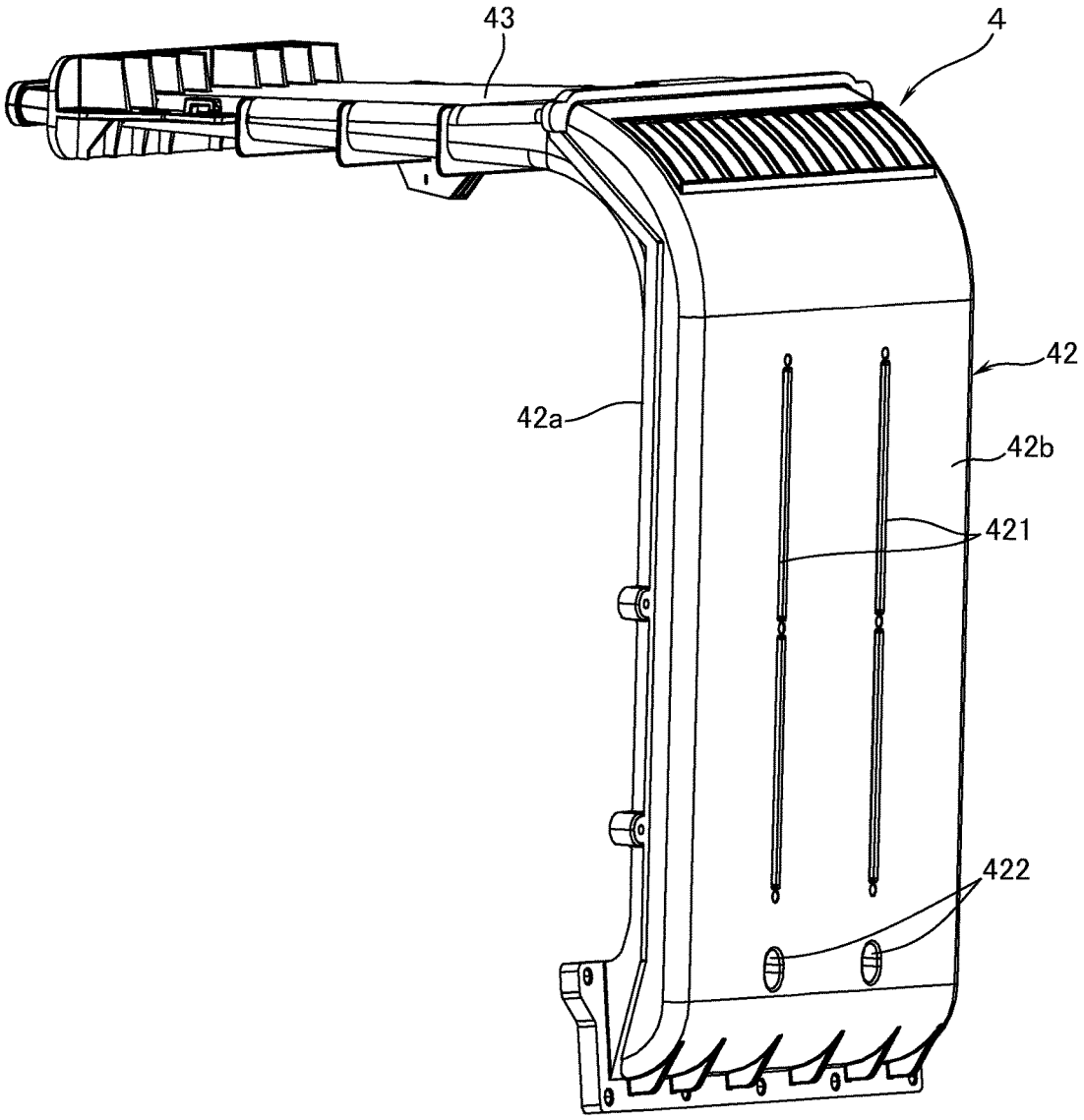
FIG. 4 is a perspective view, as seen from the back side, of the exhaust duct according to the first embodiment.
Figure 5:
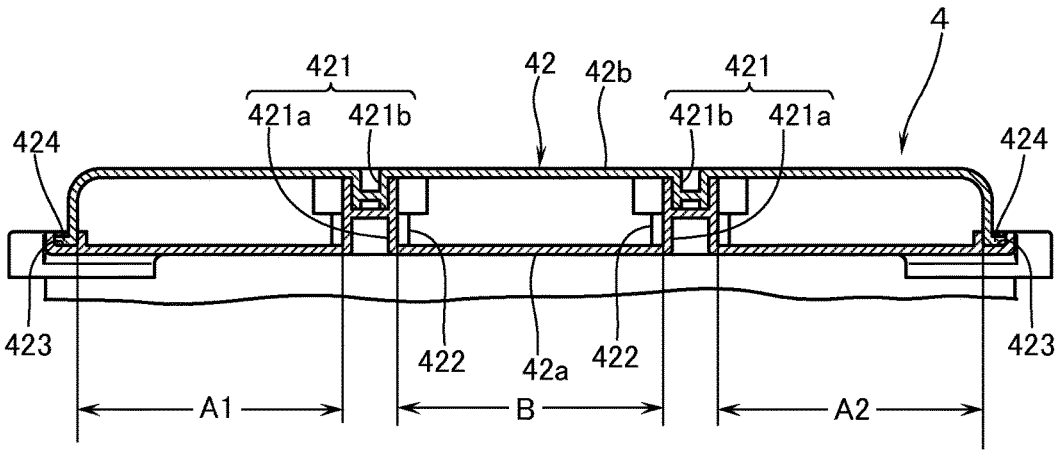
FIG. 5 is a sectional view taken along the line V-V in FIG. 3.

With reference also to FIGS. 3 to 5, the exhaust duct 4 is provided with: a vertically elongated riser duct section 42 having that inlet port 41 at a bottom front surface which is connected to the exhaust port 25; and a flat horizontal duct section 43 which is bent at an upper end of the riser duct section 42 so as to be elongated forward. It is thus so arranged that the combustion gas from the exhaust port 25 is exhausted to the outside from an outlet 44 at a front end of the horizontal duct section 43, through the riser duct section 42 and the horizontal duct section 43. The exhaust duct 4 is made of resin. In order to restrain the heat input from the combustion box 3 into the riser duct section 42 positioned on the back side of the combustion box 3, there is disposed a heat shield plate 45 on the front side of the riser duct section 42.

By the way, the riser duct section 42 is formed into a flat shape having a smaller dimension in the front-to-back direction than the dimension in the lateral direction. By thus forming the riser duct section 42 into a flat shape, the exhaust passage can be made narrower, thereby reducing the exhaust noises.

However, a flat riser duct section 42 has a larger area in each of the front-side and the back-side plate parts 42*a*, 42*b* of the riser duct section 42, thereby giving rise to the possibility of deflections. As a result, the width of the exhaust passage between the front-side and the back-side plate parts 42*a*, 42*b* fluctuates, and the pressure loss in the narrow-width parts becomes larger. In this case, in order to prevent the deflection from taking place to each of the front-side and the back-side plate parts 42*a*, 42*b* by increasing the rigidity of each of the front-side and the back-side plate parts of the riser duct section 42, it is conceivable to provide the external surface of each of the plate parts 42*a*, 42*b* with a rib. However, if such a rib is provided, the front-to-back dimension of the riser duct section 42 will increase, thereby bringing about the enlargement of the exhaust duct 4 and consequent enlargement of the combustion apparatus.

As a solution, in this embodiment, inside the riser duct section 42, a plurality of (e.g., two) rails 421 which are elongated in the vertical direction, are disposed in a manner to connect the front-side and the back-side plate parts 42*a*, 42*b* together. Each of the rails 421 is constituted by fitting an H-shaped back rail part 421*b* which is disposed on the back-side plate part 42*b* to protrude forward, into an H-shaped front rail part 421*a* which is disposed on the front-side plate part 42*a* to protrude forward.

By disposing the rails 421 in this manner, both the front-side and the back-side plate parts 42*a*, 42*b* are coupled together by the rails 421, and the fluctuations in the width of the exhaust passage between both the front-side and the back-side plate parts 42*a*, 42*b* can be restrained. Further, since the rails 421 are disposed on the inside of the riser duct section 42, the dimension in the front-to-back direction will not increase, thereby preventing the exhaust duct 4 from getting larger in size.

Further, at the bottom of the riser duct section 42, a plurality of (e.g., two) bottomed duct coupling parts 422, which are recessed from the back-side plate parts 42*b* forward, are disposed in a lower portion of the riser duct section and at a position above the inlet port so as to couple the riser duct section 42 from the back side thereof to the combustion box 2 with screws 422*a*. In addition, in this embodiment the position of disposing the rails 421 is right above the duct coupling parts 422. According to this arrangement, the combustion gas that comes in from the inlet port 41 to flow upward by detouring around the duct coupling parts 422 will flow smoothly upward without hitting the lower ends of the rails 42. As a result, the increase in the pressure loss and the noises due to the occurrence of turbulent flows can be restrained.

By the way, the front-side and the back-side plate parts 42*a*, 42*b* of the riser duct section 42 are integrated by plastic moulding in a state in which flange part 424 formed in the side end part on both lateral sides of the back-side plate part 42*b* is inserted into a groove formed in the lateral both side-end parts of the front-side plate part 42*a*.

Figure 6:
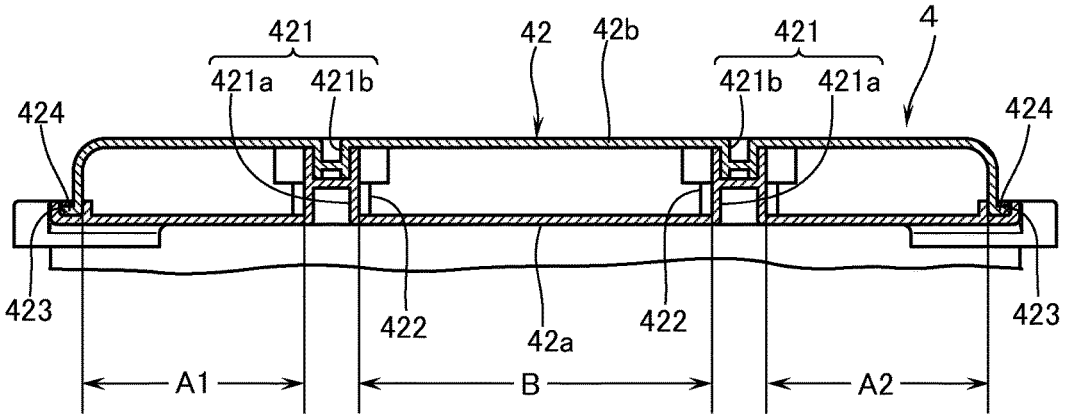
FIG. 6 is a sectional view of the exhaust duct according to a second embodiment.

By the way, in the above-mentioned first embodiment, the distance A1 between a side edge of laterally one side of the riser duct section 42 and the adjoining rail 421, and the distance A2 between a side edge of laterally opposite side of the riser duct section 42 and the adjoining rail 421, and the distance B between the rails 421, 421 are equal to one another. Alternatively, at least one distance of these distances A1, A2, B may be made different from the remaining distances. According to this arrangement, the space partitioned by each of the rails 421 comes to have different natural frequencies. Therefore, the resonant vibrations of the exhaust duct 4 due to flame vibrations and consequent resonance sound caused thereby can be prevented. This kind of second embodiment is shown in FIG. 6. In the second embodiment, the distance B is made different from the distances A1, A2. Alternatively, the distance A1 may be made different from the distances A2, B, or the distance A2 may be made different from the distances A1, B, or else, all of the distances A1, A2, B may be made different from one another. By the way, in case there is only one rail 421 so that the distance B is zero, the distance A1 and the distance A2 may be made different from each other. Further, in case there are disposed more than three rails 421, the distances between respective rails 421 may be made different from one another.

Figure 7:
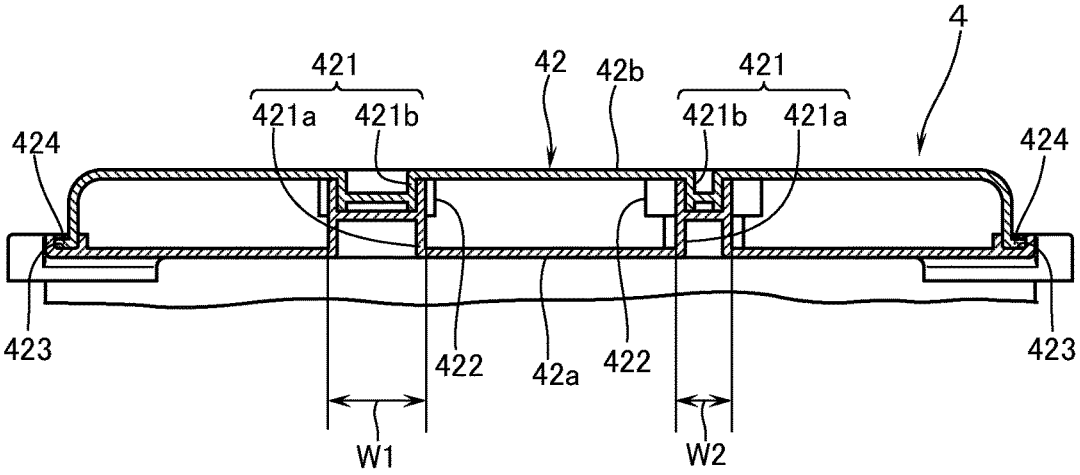
FIG. 7 is a sectional view of the exhaust duct according to a third embodiment.
Figure 8:
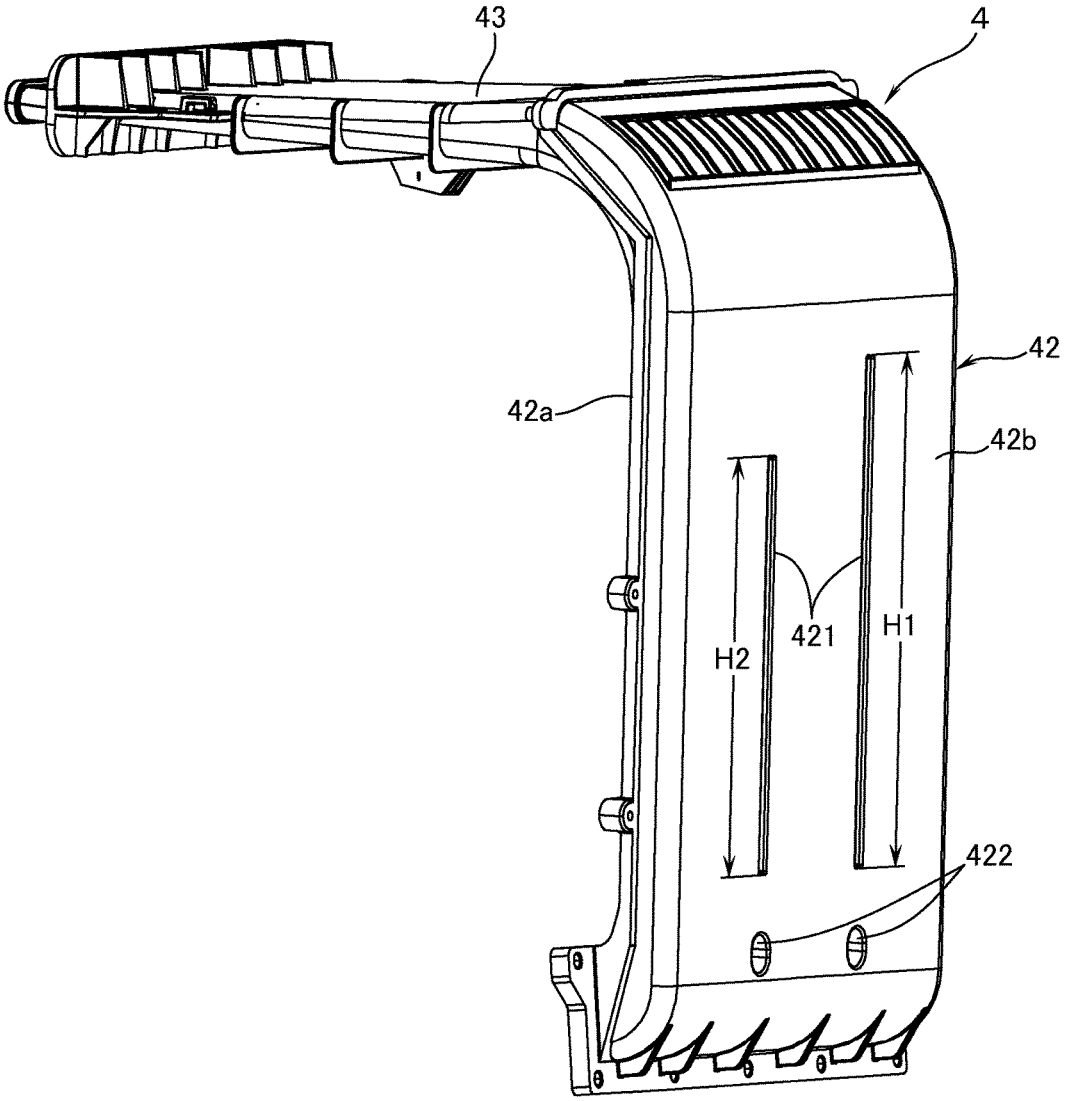
FIG. 8 is a perspective view, as seen from the back side, of the exhaust duct according to a fourth embodiment of the exhaust duct.

Further, among a plurality of rails 421 that are disposed, also in case the lateral dimension or the vertical dimension of at least one rail 421 is made different from the lateral dimension or the vertical dimension of the other rails 421, similar effect can be obtained. This kind of embodiments are shown in FIGS. 7 and 8. In the third embodiment as shown in FIG. 7, the lateral width W1 of the rail 421 on laterally one side (left side in FIG. 7) is made different from the lateral with W2 of the rail 421 on the laterally opposite side (right side in FIG. 7). Further, in the fourth embodiment as shown in FIG. 8, a vertical dimension H1 of the rail 421 on laterally one side (right side in FIG. 8) is made to vary from the vertical dimension of the rail on laterally the opposite side (left side in FIG. 8).

Descriptions have so far been made of embodiments of this invention with reference to figures. This invention shall, however, be not limited to the above. For example, in the above embodiments the exhaust port 25 is opened on the bottom back surface of the combustion box 2. It may alternatively be so arranged that the lower portion of the riser duct section 42 is bent into L-shape so as to lie along the lower surface of the combustion box 2 and that the inlet port to be connected to the exhaust port is opened on the upper surface of the bent portion.

EXPLANATION OF MARKS

1 burner
2 combustion box
3 heat exchanger
4 exhaust duct
41 inlet port
42 riser duct section
42*a* front-side plate part
42*b* back-side plate part
421 rail
422 duct coupling part

What is claimed is:

1. An exhaust duct disposed on a combustion apparatus, the combustion apparatus comprising: a burner which ejects air-fuel mixture downward for combustion; and a combustion box which houses therein a heat exchanger heated by combustion gas and which is disposed under the burner;

the exhaust duct comprising:

a riser duct section having such an inlet port at a lower-portion thereof as is connected to an exhaust port for combustion gas, the exhaust port being opened at a lower portion of the combustion box, the riser duct section extending upward along an external surface of the combustion box;

wherein a side of the riser duct section facing to the external surface of the combustion box is defined as a front side, an opposite side thereof is defined as a back side, a horizontal direction perpendicular to a front-to-back direction is defined as a lateral direction, and the riser duct section is formed into a flat shape having a smaller dimension in the front-to-back direction than the dimension in the lateral direction;

wherein the riser duct section comprises a rail inside the riser duct section, the rail being elongated in a vertical direction and connecting together a front-side plate part and a back-side plate part in order to restrain fluctuations in width of between the front-side plate part and the back-side plate part and in order to prevent the exhaust duct from getting larger in size.

2. The exhaust duct according to claim 1, further comprising a duct coupling part disposed in a lower portion of the riser duct section and at a position above the inlet port so as to couple the riser duct section from the back side thereof to the combustion box, wherein the position of disposing the rail is right above the duct coupling part.

3. The exhaust duct according to claim 1 wherein, comprising:

a distance between a side edge of laterally one side of the riser duct section and an adjoining rail;

a distance between a side edge of laterally opposite side of the riser duct section and an adjoining rail; and, in case a plurality of rails are disposed, a distance between the respective rails, wherein at least one of the above distances is varied from the remaining distances.

4. The exhaust duct according to claim 1, wherein a plurality of rails is disposed, and a lateral dimension or a vertical dimension of at least one of the rails is varied in the vertical dimension or vertical dimension of the remaining rails.

* * * * *